US005703022A

United States Patent [19]

Floyd

[11] Patent Number: 5,703,022

[45] Date of Patent: Dec. 30, 1997

[54] SULFURIZED VEGETABLE OILS CONTAINING ANTI-OXIDANTS FOR USE AS BASE FLUIDS

[75] Inventor: Robert L. Floyd, Warrensville Heights, Ohio

[73] Assignee: The Lubrizol Corporation, Wickliffe, Ohio

[21] Appl. No.: 779,872

[22] Filed: Jan. 6, 1997

[51] Int. Cl.[6] ..... C10M 141/08; C10M 141/10

[52] U.S. Cl. ..... 508/345; 508/491

[58] Field of Search ..... 508/344, 345, 508/491

[56] References Cited

U.S. PATENT DOCUMENTS

| | | | |
|---|---|---|---|
| 3,850,825 | 11/1974 | Vienna et al. | 508/345 |
| 4,045,363 | 8/1977 | Lee et al. | 252/49.5 |
| 4,148,737 | 4/1979 | Liston et al. | 252/32.7 E |
| 4,148,739 | 4/1979 | Liston et al. | 252/32.7 E |
| 4,584,113 | 4/1986 | Walsh | 252/45 |
| 4,664,825 | 5/1987 | Walsh | 252/45 |
| 4,925,581 | 5/1990 | Erickson et al. | 252/48.2 |
| 4,957,651 | 9/1990 | Schwind | 508/345 |
| 4,959,168 | 9/1990 | Schroeck | 252/48.6 |
| 4,970,010 | 11/1990 | Erickson et al. | 252/48.6 |
| 4,978,465 | 12/1990 | Sturwold | 508/344 |
| 5,229,023 | 7/1993 | Landis | 508/491 |
| 5,282,989 | 2/1994 | Erickson et al. | 252/48.2 |
| 5,413,725 | 5/1995 | Lal et al. | 252/18 |
| 5,427,700 | 6/1995 | Stoffa | 508/491 |

*Primary Examiner*—Jacqueline V. Howard
*Attorney, Agent, or Firm*—James L. Cordek; Frederick D. Hunter; Joseph P. Fischer

[57] ABSTRACT

A composition is disclosed which is directed to an oxidatively stable environmentally friendly lubricant base fluid comprising (A) at least one sulfurized triglyceride oil and (B) at least one oxidation inhibitor selected from the group consisting of (1) an alkyl phenol of the formula

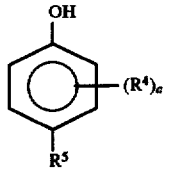

wherein $R^4$ is an alkyl group containing from 1 up to 24 carbon atoms, $R^5$ is hydrogen, an alkyl group containing 1 or 2 carbon atoms or $R^4$, and a is an integer of from 1 up to 4;

(2) an ether of the formula

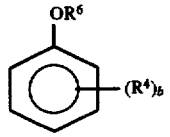

wherein $R^6$ is an alkyl group containing from 1 up to 12 carbon atoms, $R^4$ is an alkyl group containing from 1 up to 24 carbon atoms and b is an integer of from 1 up to 5; and (3) at least one aromatic amine of the formula

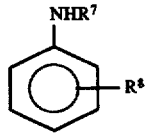

wherein $R^7$ is

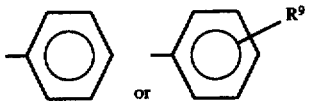

and $R^8$ and $R^9$ are independently a hydrogen or an alkyl group containing from 1 up to 23 carbon atoms.

20 Claims, No Drawings

SULFURIZED VEGETABLE OILS CONTAINING ANTI-OXIDANTS FOR USE AS BASE FLUIDS

FIELD OF THE INVENTION

The present invention relates to vegetable oils that have been sulfurized with not more than 4 percent sulfur and contain an anti-oxidant. This composition of a sulfurized vegetable oil and anti-oxidant gives rise to an oxidatively stable environmentally friendly lubricant base fluid.

BACKGROUND OF THE INVENTION

Successful use of vegetable oils as environmentally friendly, that is, biodegradable base fluids in individual applications, e.g., farm tractor fluids, is contingent upon improving oxidative stability. Naturally occurring vegetable oils with high amounts of saturation, such as coconut oil (92% saturated) have excellent oxidative stability. Vegetable oils with high amounts of polyunsaturation present, e.g., as linoleic and linolenic content have poor oxidative stability. Examples of vegetable oils having poor oxidative stability are soybean oil and sunflower oil. The total linoleic and linolenic content of these oils are 61 and 68 percent, respectively.

U.S. Pat. No. 4,148,737 (Liston et al., Apr. 10, 1979) relates to a lubricating oil additive composition which imparts improved oxidation properties to lubricants which comprises:

(1) an antioxidant selected from aromatic or alkyl sulfides and polysulfides, sulfurized olefins, sulfurized carboxylic acid esters and sulfurized ester-olefins, and (2) an oil-soluble brominated hydrocarbon containing at least three carbon atoms.

U.S. Pat. No. 4,148,739 (Liston et al., Apr. 10, 1979) relates to a lubricating oil additive composition which imparts improved oxidation properties to lubricants which comprises:

(1) an antioxidant selected from aromatic or alkyl sulfides and polysulfides, sulfurized olefins, sulfurized carboxylic acid esters and sulfurized ester-olefins, and (2) an oil-soluble iodo-containing hydrocarbon.

U.S. Pat. Nos. 4,970,010 and 5,282,989 (Erickson et al., Nov. 13, 1990 and Feb. 1, 1994) encompass lubricant additives comprising combinations of triglyceride vegetable oil with at least one of a sulfurized vegetable oil and a phosphite adduct of vegetable oil. The vegetable oil is a triglyceride in its native state with the fatty acids having from about 16 to about 26 carbon atoms and at least one double bond, but no more than three double bonds for at least 90% of the fatty acids. Preferably, the vegetable oil fatty acids are $C_{18-22}$ with the majority of fatty acids having one double bond. Most preferably, the vegetable oil is meadowfoam oil, rapeseed oil or crambe oil.

U.S. Pat. No. 4,045,363 (Lee et al., Aug. 30, 1977)relates to stable water-in-oil invert emulsions suitable for use as fire-resistant lubricants and as fire-resistant hydraulic fluids of improved extreme pressure (E.P.) properties. A mixture of polyisobutenyl succinic anhydride, a member selected from the group consisting of a vegetable or animal oil or a mixture thereof, and a mono alpha-unsaturated olefin is sulfurized under heat. The sulfurized mixture is then reacted with a hydrophile on an equivalent basis. This compound is then blended with suitable base stock to form an invert emulsion with improved E.P. and anti-wear properties.

U.S. Pat. Nos. 4,584,113 and 4,664,825 (Walsh, Apr. 22, 1986 and May 12, 1987) relate to a sulfurized composition prepared by sulfurizing a mixture of at least one terpene and at least one other olefinic compound. More particularly, sulfurized compositions prepared by sulfurizing a mixture of pine oil and at least one other olefinic compound are described. Such sulfurized compositions are useful as additive compositions in industrial and gear lubricants, and more particularly, as lubricant additive compositions. The compositions when added to lubricants provide lubricants which exhibit improved antioxidant characteristics, nitrile seal compatibility and acceptable color characteristics.

U.S. Pat. No. 4,959,168 (Schroeck, Sep. 25, 1990) relates to sulfurized compositions which are prepared by reacting at an elevated temperature, a sulfurizing agent with a mixture of (A) at least one partial fatty acid ester of a polyhydric alcohol and (B) at least one member of the group consisting of (1) at least one fatty acid ester of a polyhydric alcohol, which fatty acid ester is different from the partial ester (A), (2) at least one fatty acid, (3) at least one olefin, and (4) at least one fatty acid ester of a monohydric alcohol.

U.S. Pat. No. 4,957,651 (Schwind, Sep. 18, 1990) relates to lubricants comprising a partial fatty acid ester of a polyhydric alcohol and a cosulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol, provide a synergistic benefit.

U.S. Pat. No. 4,925,581 (Erickson et al., May 15, 1990) encompasses lubricant additives comprising combinations of meadowfoam oil with at least one of sulfurized meadowfoam oil and a phosphite adduct of meadowfoam oil. The meadowfoam oil can be in the form of the native triglyceride or as a meadowfoam wax ester. The sulfurized meadowfoam oil comprises either a sulfurized mixture of the triglyceride form of meadowfoam oil with from about 25% to about 75% of a wax ester or sulfurized meadowfoam wax ester. The wax ester is jojoba oil or is derived from a $C_{18-22}$ unsaturated acid and a $C_{18-22}$ unsaturated alcohol. Preferably, the wax ester is a naturally occurring wax ester, such as jojoba oil, or the wax ester of meadowfoam oil. The phosphite adduct of meadowfoam oil can be a mono- through hexa-adduct of the triglyceride form of meadowfoam oil, or a mono- through tetra-adduct of the wax ester form of meadowfoam oil.

U.S. Pat. No. 5,413,725 (Lal et al., May 9, 1995) relates to an industrial lubricant composition that comprises (A) at least one vegetable or synthetic triglyceride oil of the formula

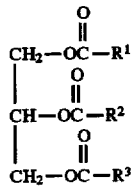

wherein $R^1$, $R^2$ and $R^3$ are aliphatic-hydrocarbyl groups having at least 60 percent monounsaturated character and containing from about 6 to about 24 carbon atoms further wherein an oleic acid moiety:linoleic acid moiety is from about 2 up to about 90 and (B) at least one pour point depressant. Optionally, the composition may also contain (C) a performance additive and
(D) an oil.

SUMMARY OF THE INVENTION

A composition is disclosed which is directed to an oxidatively stable environmentally friendly lubricant base fluid comprising (A) at least one sulfurized triglyceride oil and
(B) at least one oxidation inhibitor selected from the group consisting of
(1) an alkyl phenol of the formula

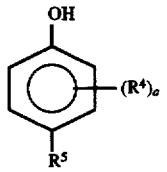

wherein $R^4$ is an alkyl group containing from 1 up to 24 carbon atoms, $R^5$ is hydrogen, an alkyl group containing 1 or 2 carbon atoms or $R^4$ and a is an integer of from 1 up to 4;

(2) an ether of the formula

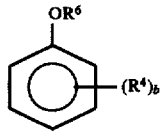

wherein $R^6$ is an alkyl group containing from 1 up to 12 carbon atoms, $R^4$ is an alkyl group containing from 1 up to 24 carbon atoms and b is an integer of from 1 up to 5; and (3) at least one aromatic amine of the formula

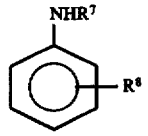

wherein $R^7$ is

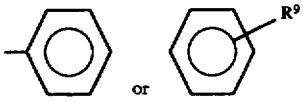

$R^8$ and $R^9$ are independently a hydrogen or an alkyl group containing from 1 up to 23 carbon atoms.

DETAILED DESCRIPTION OF THE INVENTION

(A) The Sulfurized Triglyceride Oil

In practicing the invention, a triglyceride oil is sulfurized. The triglyceride oil is a synthetic triglyceride or a natural oil of the formula

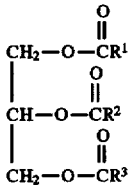

wherein $R^1$, $R^2$ and $R^3$ are aliphatic hydrocarbyl groups that contain from about 7 to about 23 carbon atoms with the proviso that the aliphatic hydrocarbyl groups are at least 5 percent monounsaturated. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are vegetable oil triglycerides. The synthetic triglycerides are those formed by the reaction of one mole of glycerol with three moles of a fatty acid or mixture of fatty acids. In preparing a synthetic triglyceride, the fatty acid contains from 5 to 23 carbon atoms. Preferably the fatty acid is oleic acid, linoleic acid, linolenic acid or mixtures thereof. Most preferably, the fatty acid is oleic acid. Of the vegetable oil triglycerides and the synthetic triglycerides, preferred are vegetable oil triglycerides. The preferred vegetable oils are corn oil, soybean oil, meadowfoam oil, rapeseed oil, sunflower oil, palm oil, coconut oil, cottonseed oil, lesquerella oil, canola oil, olive oil, peanut oil, safflower oil and castor oil.

Each vegetable oil has its own fatty acid composition profile. For example, the profile of palm oil, obtained from the seed of *Elaeis guineensis*, is 29.6 percent oleic acid, 7.2 percent linoleic acid, 0.1 percent linolenic acid and the remainder of 63.1 percent as saturated acids. By controlled hydrogenation, it is possible to reduce the linolenic content (a three double bond acid moiety) to not more than 0.25 percent residual linolenic content. While it is possible to eliminate the linoleic content, (a two double bond acid moiety) to do so would cause some of the oleic content to be reduced to a stearic content. It is desirable to maintain as high an oleic content as possible by the use of controlled hydrogenation. Several vegetable oils such as rapeseed oil and canola oil contain 11.0 percent and 8.8 percent linoleic content, respectively. A benefit is achieved when these oils are partially hydrogenated to reduce the residual linolenic content to not more than 0.25 percent. The benefit is that the linolenic content is converted to a linoleic content. The following is a list of vegetable oils that are partially hydrogenated to contain no more than 0.25 percent linolenic acid: sunflower oil, safflower oil, coconut oil, cottonseed oil, olive oil, palm oil, canola oil, rapeseed oil, corn oil, and soybean oil.

In another embodiment, the aliphatic hydrocarbyl groups are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are at least 60 percent heptadecenyl groups and the $R^1COO^-$, $R^2COO^-$ and $R^3COO^-$ to the 1,2,3-propanetriyl group $—CH_2CHCH_2—$ are the residue of an oleic acid molecule. U.S. Pat. No. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil, high oleic cottonseed oil and high oleic soybean oil. Canola oil is a variety of rapeseed oil containing less than 1 percent erucic acid. A preferred high oleic vegetable oil is high oleic sunflower oil obtained from *Helianthus sp.* This product is available from A C Humko Corporation, Memphis, Tenn. as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from *Brassica campestris* or *Brassica napus,* also available from A C Humko Corporation as RS high oleic rapeseed oil. RS80 oil signifies a rapeseed oil wherein the acid moieties comprise 80 percent oleic acid.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di- unsaturated acid moieties (20+70) or (40+50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

While the sulfurization of compounds contain double bonds is old in the art, the sulfurization of a vegetable oil must be done in a manner that total vulcanization does not occur. A direct sulfurization (utilizing elemental sulfur) done by reacting the vegetable oil with sulfur and reacting all or almost all of the double bonds present in the vegetable oil, will give a vulcanized product wherein if the product is not solid, it would have an extremely high viscosity. Other methods of sulfurization are known to those skilled in the art. A few of these sulfurization methods are sulfur monochloride; sulfur dichloride; sodium sulfide/$H_2S$/sulfur; sodium sulfide/$H_2S$; sodium sulfide/sodium mercaptide/sulfur and sulfurization utilizing a chain transfer agent.

The sulfurized vegetable oil has a sulfur level generally from 0.3 to 4 percent by weight, preferably from 0.3 to 3 percent by weight and most preferably from 0.5 to 2.0 percent by weight.

The following examples illustrate the preparation of (A) the sulfurized triglyceride oil. Temperatures, unless indicated otherwise, are in degrees Celsius.

Example A-1

Added to 2 liter, 4 neck flask fitted with a stirrer, thermowell, gas inlet tube and Dean Stark trap with reflux condenser are 990 parts soybean oil and 10 parts elemental sulfur. The contents are heated to 150° C. for 3 hours while sparging with nitrogen at 0.75 cubic feet per hour. The contents are permitted to cool to room temperature and filtered to give a product containing 1.0 percent sulfur.

Example A-2

Added to a 5 liter flask as in Example A-1 are 2970 parts soybean oil. The contents are heated and stirred and at 50° C. charged is 30 parts elemental sulfur. The temperature is increased to 150° C. and held for 2 hours. The contents are cooled to room temperature and filtered to give a product containing 1.06% sulfur.

Example A-3

Added to a 5 liter flask as fitted in Example A-1 are 2940 parts soybean oil and 60 parts elemental sulfur. The contents are heated to 150° C. over a 2.5 hour period and held at this temperature for 2 hours. The contents are cooled to room temperature and filtered to give a product containing 2.05% sulfur.

(B) The Oxidation Inhibitor

Several oxidation inhibitors are envisioned in practicing this invention. The oxidation inhibitor (B) is selected from the group consisting of (1) an alkyl phenol, (2) an ether, and (3) an aromatic amine.

(B1) The Alkyl Phenol

Component (B1) is an alkyl phenol of the formula

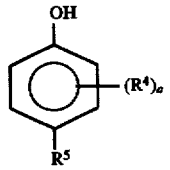

wherein $R^4$ is an alkyl group containing from 1 to 24 carbon atoms, $R^5$ is hydrogen, an alkyl group containing 1 or 2 carbon atoms or $R^4$, and a is an integer of from 1 to 4.

Preferably $R^4$ contains from 1 to 18 carbon atoms and most preferably from 1 to 8 carbon atoms. The preferred value of a is 1 to 3 and most preferred is 2. An especially preferred value of $R^5$ is hydrogen.

Two preferred alkyl phenols are 2,6-di-t-butyl phenol

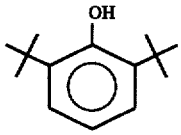

where $R^4$ is t-butyl, $R^5$ is hydrogen and a is 2 and butylated hydroxytoluene (2,6-di-t-butyl-p-cresol)

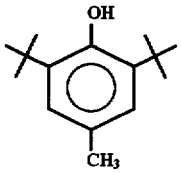

where $R^4$ is t-butyl, $R^5$ is methyl and a is 2.

(B2) The Ether

Component (B2) is an ether of the formula

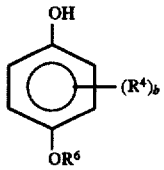

wherein $R^4$ is an alkyl group containing from 1 to 24 carbon atoms, $R^6$ is an alkyl group containing from 1 to 12 carbon atoms and b is an integer of from 1 to 4. Preferably $R^4$ contains from 1 to 18 carbon atoms and most preferably from 1 to 8 carbon atoms. The preferred value of b is from 1 to 3 and especially preferred is 1. Preferably $R^6$ contains from 1 to 8 carbon atoms and most preferably from 1 to 4 carbon atoms.

A preferred ether is butylated hydroxy anisole, BHA

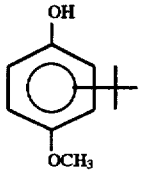

where $R^4$ is t-butyl, $R^6$ is methyl and b is 1.

(B3) The Aromatic Amine

Component (B3) is at least one aromatic amine of the formula

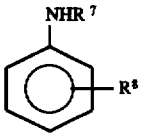

wherein $R^7$ is

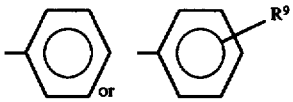

$R^8$ and $R^9$ are independently a hydrogen or an alkyl group containing from 1 up to 24 carbon atoms. Preferably $R^7$ is

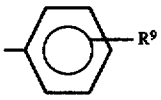

and $R^8$ and $R^9$ are alkyl groups containing from 4 to about 18 carbon atoms. In a particularly advantageous embodiment, component (B3) comprises alkylated diphenylamine such as nonylated diphenylamine of the formula

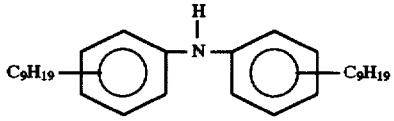

The compositions of the present invention comprising components (A) and (B) are useful as environmentally friendly, biodegradable base fluids in industrial applications. Typically the weight ratio of (A):(B) is from (90–99.95):(0.05–10), preferably from (95–99.95):(0.05–5) and most preferably from (97.5–99.95):(0.05–2.5).

A series of blends are prepared and evaluated in an air oxidation test wherein the blends are incorporated into a fully formulated automatic transmission fluid. The blends are tested and evaluated in Table I for air oxidation measuring hours to failure. A baseline formulation containing 100 parts soybean oil gives 73 hours to fail.

TABLE I

| Blend | (A) | (B) | Hours to Fail |
|---|---|---|---|
| 1 | | | 73 |
| 2 | 100 parts Example A-3 | | 81 |
| 3 | 99.7 parts Example A-3 | 0.3 parts nonylated diphenylamine | 89 |
| 4 | 99.5 parts Example A-3 | 0.5 parts nonylated diphenylamine | 89 |
| 5 | 99.7 parts Example A-3 | 0.3 parts 2,6-di-t-butyl-p-cresol | 89 |
| 6 | 99.5 parts Example A-3 | 0.5 parts 2,6-di-t-butyl-p-cresol | 89 |
| 7 | 99.7 parts Example A-3 | 0.3 parts 2,6-di-t-butylphenol | 89 |
| 8 | 99.5 parts Example A-3 | 0.5 parts 2,6-di-t-butylphenol | 89 |

While the invention has been explained in relation to its preferred embodiments, it is to be understood that various modifications thereof will become apparent to those skilled in the art upon reading the specification. Therefore, it to be understood that the invention disclosed herein is intended to cover such modifications as fall within the scope of the appended claims.

What is claimed is:

1. An oxidatively stable environmentally friendly lubricant base fluid comprising (A) at least one sulfurized triglyceride oil wherein the sulfurized triglyceride contains from 0.3 to 3.0 percent by weight of sulfur and (B) at least one oxidation inhibitor selected from the group consisting of (1) an alkyl phenol of the formula

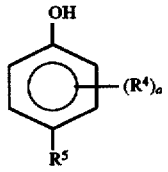

wherein $R^4$ is an alkyl group containing from 1 to 24 carbon atoms, $R^5$ is hydrogen, an alkyl group containing 1 or 2 carbon atoms or $R^4$, and a is an integer of from 1 up to 4;

(2) an ether of the formula

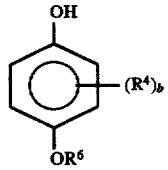

wherein $R^6$ is an alkyl group containing from 1 to 12 carbon atoms, $R^4$ is an alkyl group containing from 1 to 24 carbon atoms and b is an integer of from 1 up to 4; and (3) at least one aromatic amine of the formula

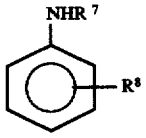

wherein $R^7$ is

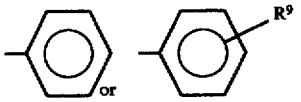

and $R^8$ and $R^9$ are independently a hydrogen or an alkyl group containing from 1 to 23 carbon atoms.

2. The fluid of claim 1 wherein the triglyceride is a natural or synthetic triglyceride of the formula

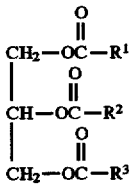

wherein $R^1$, $R^2$ and $R^3$ are independently saturated or unsaturated aliphatic hydrocarbyl groups that contain from about 7 to about 23 carbon atoms with the proviso that the aliphatic hydrocarbyl groups are at least 5 percent monounsaturated.

3. The fluid of claim 2 wherein the natural triglyceride is a genetically modified vegetable oil triglyceride wherein $R^1$, $R^2$ and $R^3$ are aliphatic groups that are at least 60 percent monounsaturated wherein the monounsaturated character is due to an oleic acid residue and further wherein an oleic acid moiety:linoleic acid moiety ratio is from 2 up to about 90.

4. The fluid of claim 2 wherein the synthetic triglyceride is an ester of at least one straight chain fatty acid and glycerol wherein the fatty acid contains from about 5 to about 23 carbon atoms.

5. The fluid of claim 3 wherein the triglyceride is at least 70 percent monounsaturated.

6. The fluid of claim 3 wherein the triglyceride is at least 80 percent monounsaturated.

7. The fluid of claim 4 wherein the monounsaturated fatty acid is oleic acid.

8. The fluid of claim 2 wherein the natural triglyceride is a vegetable oil that comprises sunflower oil, safflower oil, corn oil, soybean oil, rapeseed oil, meadowfoam oil, coconut oil, peanut oil, olive oil, palm oil, canola oil, cottonseed oil, lesquerella oil, or castor oil.

9. The fluid of claim 8 wherein any of sunflower oil, safflower oil, coconut oil, cottonseed oil, olive oil, palm oil, canola oil, rapeseed oil, corn oil or soybean oil are hydrogenated to contain no more than 0.25 percent residual linolenic content.

10. The fluid of claim 3 wherein the genetically modified vegetable oil comprises high oleic sunflower oil, high oleic safflower oil, high oleic corn oil, high oleic soybean oil, high oleic rapeseed oil, high oleic cottonseed oil, high oleic canola oil or high oleic peanut oil.

11. The fluid of claim 1 wherein the triglyceride is sulfurized with elemental sulfur.

12. The fluid of claim 1 wherein the triglyceride is sulfurized with elemental sulfur and hydrogen sulfide.

13. The fluid of claim 1 wherein the sulfurized triglyceride contains from 0.5 to 2.0 percent by weight of sulfur.

14. The fluid of claim 1 wherein within (B1), a is 2 and $R^4$ contains from 1 up to 8 carbon atoms.

15. The fluid of claim 1 wherein within (B1), a is 2, $R^4$ is t-butyl and $R^5$ is hydrogen.

16. The fluid of claim 1 wherein within (B1), a is 2, $R^4$ is t-butyl and $R^5$ is methyl.

17. The fluid of claim 1 wherein within (B2), $R^4$ and $R^6$ independently contain from 1 up to 8 carbon atoms and b is from 1 up to 3.

18. The fluid of claim 17 wherein $R^6$ is methyl, $R^4$ is t-butyl and b is 1.

19. The fluid of claim 1 wherein within (B3), $R^7$ is

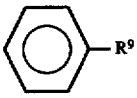

and $R^8$ and $R^9$ are alkyl groups containing from 4 to 18 carbon atoms.

20. The fluid of claim 19 wherein $R^8$ and $R^9$ are nonyl groups.

* * * * *